US005145478A

United States Patent [19]

Minoura

[11] Patent Number: 5,145,478

[45] Date of Patent: Sep. 8, 1992

[54] BICYCLE EXERCISING STAND

[75] Inventor: Chihiro Minoura, Gifu, Japan

[73] Assignee: Minoura Carrier & Stand Works, Co., Ltd., Gifu, Japan

[21] Appl. No.: 779,077

[22] Filed: Oct. 18, 1991

[30] Foreign Application Priority Data

Aug. 27, 1991 [JP] Japan ..... 3-215530

[51] Int. Cl.[5] ..... A63B 21/00

[52] U.S. Cl. ..... 482/61; 434/61

[58] Field of Search ..... 482/57, 60, 61, 62; 434/61; 211/1, 17, 22

[56] References Cited

U.S. PATENT DOCUMENTS 3,368,809 2/1968 Duane ..... 482/61
4,595,194 6/1986 Preuitali ..... 482/61
4,768,782 9/1988 Blackburn ..... 482/61

*Primary Examiner*—Stephen R. Crow

*Attorney, Agent, or Firm*—Oblon, Spivak, McClelland, Maier & Neustadt

[57] ABSTRACT

A bicycle exercise stand is disclosed for supporting the drive wheel of a bicycle during stationary pedaling exercise. The exercise stand includes a frame and positioning mechanism provided on the frame for engaging and positioning a first drive wheel hubs. A holding mechanism is provided substantially opposite to the positioning mechanism and is moveable between extended and contracted positions. The holding mechanism is arranged to engage a second drive wheel hubs in the extended position to cooperate with the positioning mechanism to rotatably hold the drive wheel. A pedal is mounted to a lower portion of the frame and is coupled to holding mechanism for moving the holding mechanism between the extended and contracted positions. The pedal may be operated by foot in order to make it easy to mount the bicycle on the stand.

17 Claims, 4 Drawing Sheets

BICYCLE EXERCISING STAND

This application claims the priority of Japanese Patent Application No. 3-215530 filed on Aug. 27, 1991, which is incorporated herein by reference.

BACKGROUND OF THE INVENTION

1. Field of the Invention

The present invention relates to a bicycle exercise stand and more particularly to an exercise stand which holds a drive wheel of a bicycle to permit a user to perform pedaling exercise.

2. Description of the Related Art

Bicycles have long been used as indoor training devices. Such training generally requires a stand which lifts the drive wheel (rear wheel) of the bicycle off of the floor and a resistance device which applies a drag force to the driven wheel. Representative prior art stands are disclosed in U.S. Pat. Nos.: 4,768,782; 4,969,642 and 5,026,047. These stands each include a frame having at least a pair of upward extending support legs. The legs in turn carry substantially horizontally extending longitudinally aligned support arms having facing sockets on their facing ends. The sockets are arranged to engage the hubs of the bicycle's drive wheel in a manner that lifts the wheel slightly off of the floor or ground. The outer periphery of the drive wheel's tire is also placed in frictional contact with a resistance applying device that is mounted to the frame. With this arrangement, the user may perform a stationary pedaling exercise by riding the bike in a normal manner.

In the stand disclosed in U.S. Pat. No. 4,768,782, the support arms take the form of opposing threaded bolts. Thus, to mount the bicycle on the stand, the user must lift the rear wheel to a position where the bicycle hubs correspond in height to the height of the support arms. The sockets are then positioned over the hubs by rotating knobs on the outer ends of the bolts. Thus, the user must holds the upper rear part of the bicycle with one hand while at the same time, rotating one of the bolts to properly mount the bicycle. Although knobs on the end of the bolts make them easier to rotate, it requires a fair amount of dexterity to simultaneously hold the bicycle in position and turn the knob. Accordingly, the actions required to set the bicycle on the stand are somewhat difficult.

The stands disclosed in U.S. Pat. Nos. 4,969,642, and 5,026,047 are quite similar to the stand described above. In effect they simply replace one of the threaded bolts with a hand lever actuated cam and piston arrangement. That is, one of the support arms has a lever mounted thereon. The lever has a cam surface that drives a piston laterally to position the second socket. Mounting a bicycle on the these stands is much like mounting a bicycle on the previously described stand. That is, the user must lift the bicycle with one hand while reaching down to operate the lever with the second hand. Accordingly, the actions required to set a bicycle on these stands is also somewhat difficult.

SUMMARY OF THE INVENTION

Accordingly, it is a primary objective of the present invention to provide a bicycle exercise stand that makes it easy to set a bicycle thereon.

To achieve the foregoing and other objects and in accordance with the purpose of the present invention, a bicycle exercise stand is provided for supporting a drive wheel of a bicycle. The bicycle exercise stand includes a frame and positioning mechanism provided on the frame for engaging and positioning a first drive wheel hubs. A holding mechanism is arranged substantially opposite to the positioning mechanism and is moveable between extended and contracted positions. The holding mechanism is arranged to engage a second drive wheel hubs in the extended position to cooperate with the positioning mechanism to rotatably hold the drive wheel. A pedal means is mounted to a lower portion of the frame and is coupled to holding mechanism for moving the holding mechanism between the extended and contracted positions.

In a preferred embodiment, the holding means a slidable piston pin. The piston pin carries a piston socket at its inner end that is arranged to engage the second wheel hub. The piston pin is arranged to slide horizontally to move the piston socket between a supporting position that supports the second hub and a free position clear of the second hub. The pedaling means may include a foot operated pedal mounted on a lower portion of the frame.

In another preferred embodiment, the positioning mechanism takes the form of a longitudinally moveable threaded bolt that carries a positioning socket on its inner end.

BRIEF DESCRIPTION OF THE DRAWINGS

The features of the present invention that are believed to be novel are set forth with particularly in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENT

Figure 1:
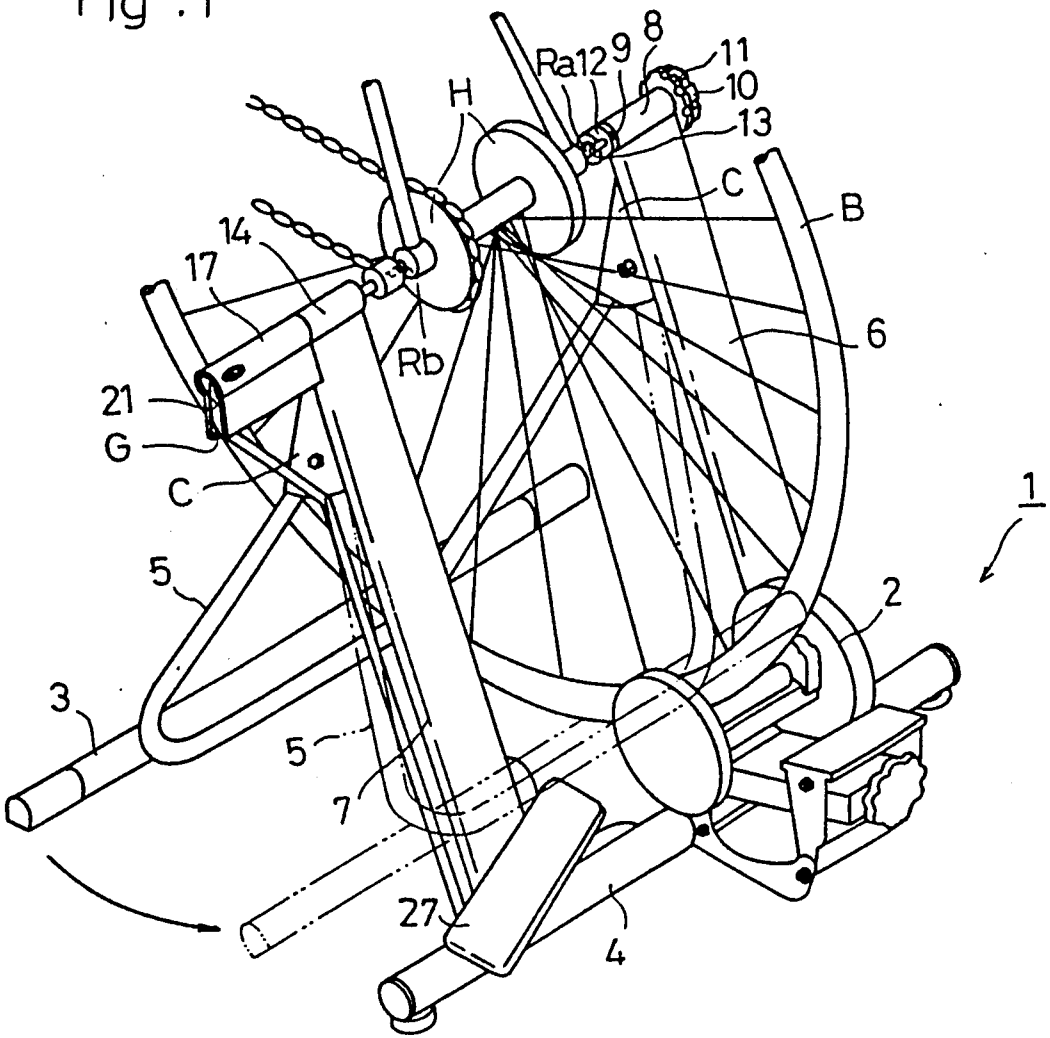
FIG. 1 is a perspective view showing a bicycle exercise apparatus of the present invention together with part of a bicycle.

One embodiment of the present invention is shown in the drawings and will be explained in detail hereinafter. In this embodiment, the invention takes the form of a free standing bicycle stand that may rest on the ground, a floor or the like. A resistance device 2 is mounted to a lower portion of the frame 1 to provide frictional resistance to the drive wheel of a bicycle that is held by the stand. By way of example, the resistance device may take the form of a conventional magnetic or wind resistance device.

The frame includes, front and rear tubular bases 3, 4 that are arranged in parallel. A U-shaped member 5 extend generally upward from the front base 3 such that both free ends thereof are inclined backward as they extend upward. A pair of leg members 6, 7 extend upward and slightly forward from the rear base 4. The free ends of the U-shaped member 5 are pivotally coupled to form the upper ends of respective leg members by hinges C. When the stand is in use, the U-shaped member 5 is pivoted to the extended position shown in FIG. 1. On the other hand, when not in use, the stand may be folded and collapsed for storage, as shown by the two-dot chain line in the same figure.

An internally threaded sleeve 8 is formed on or fixed to the upper end of the left leg 6. The sleeve 8 extends horizontally across the entire width of the leg 8. A threaded shaft 9 is threadably inserted into the threaded sleeve 8. The inner end of the threaded shaft 9 extends inward from the threaded sleeve 8. An adjust knob 10 is secured to the outer end (right side in FIG. 1) of the shaft 9. A lock knob 11 is threadably fitted onto the shaft 9 between the adjust knob 10 and the outer wall of the sleeve 8. A socket 12 is carried by the inner end of the shaft 9.

The distance that the shaft 9 extends beyond the sleeve 8 may be adjusted to accommodate different sized bicycles wheels. Specifically, the position of the socket 12 can be adjusted based on the width of the axle H of the bicycle's rear wheel B. Once the socket is properly placed in a selected positioned, the lock knob 11 is threadably advanced, until it rests against the outer wall of the sleeve 8 to lock the shaft 9. This causes the socket 12 to be immovably held at the selected position. Then, a first one of the axle hubs is placed in the positioning socket 12.

A second sleeve 14 is formed in the upper end of the left leg 7. The length of the sleeve 14 is approximately twice the width of the leg 7. About half of the sleeve 14 overhangs outward from the outer side of the leg 7. A slit 21 is formed on the lower part of the overhanging sleeve portion and extends its entire length. Additionally, a sleeve cover 17 formed of a hard resin such as polyvinyl chloride is journaled about the sleeve for protection. The lower part of the sleeve cover 17 has a slit G that corresponds in position to the sleeve slit 21.

Figure 2:
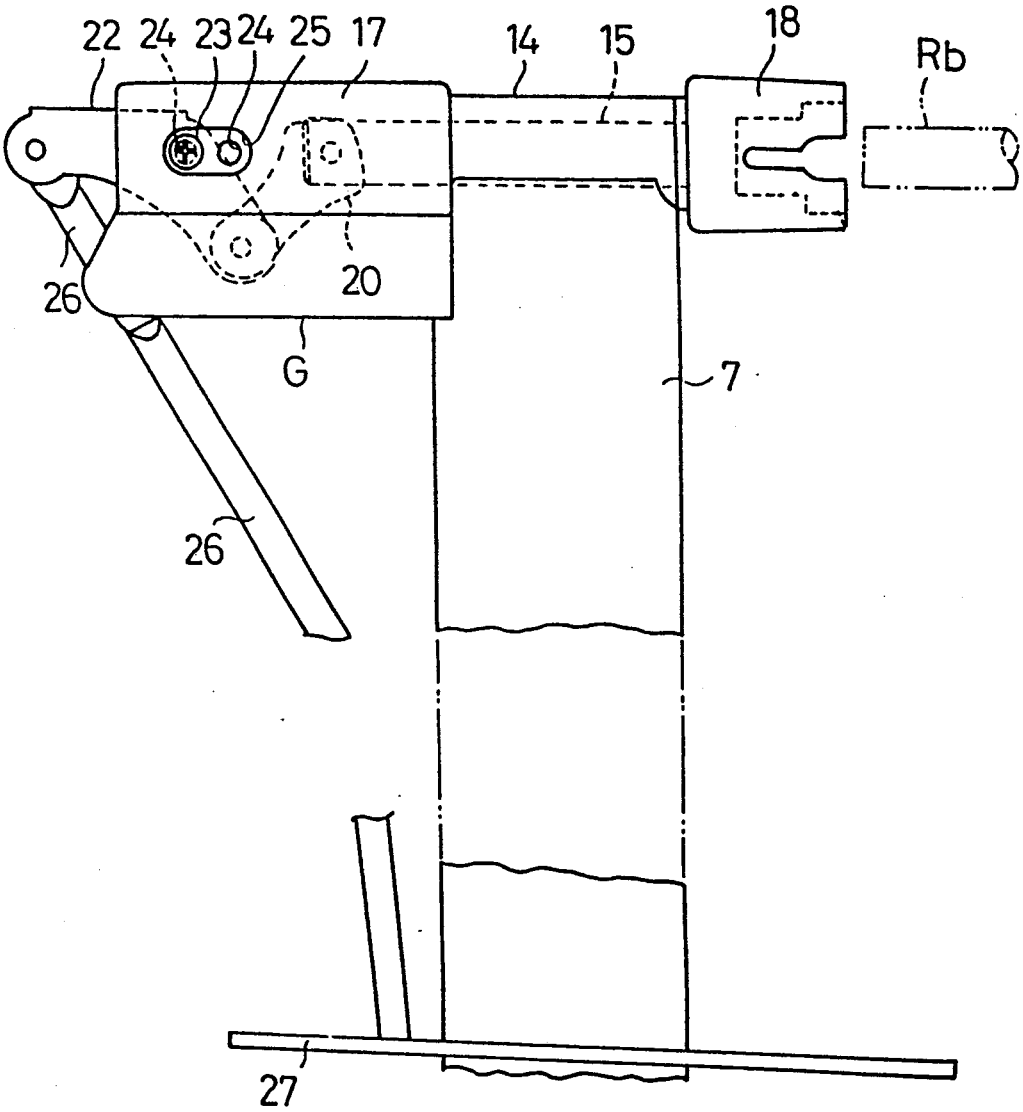
FIG. 2 is a sectional view showing the linkage between the pedal and the piston pin when the piston socket is in the retracted position.
Figure 3:
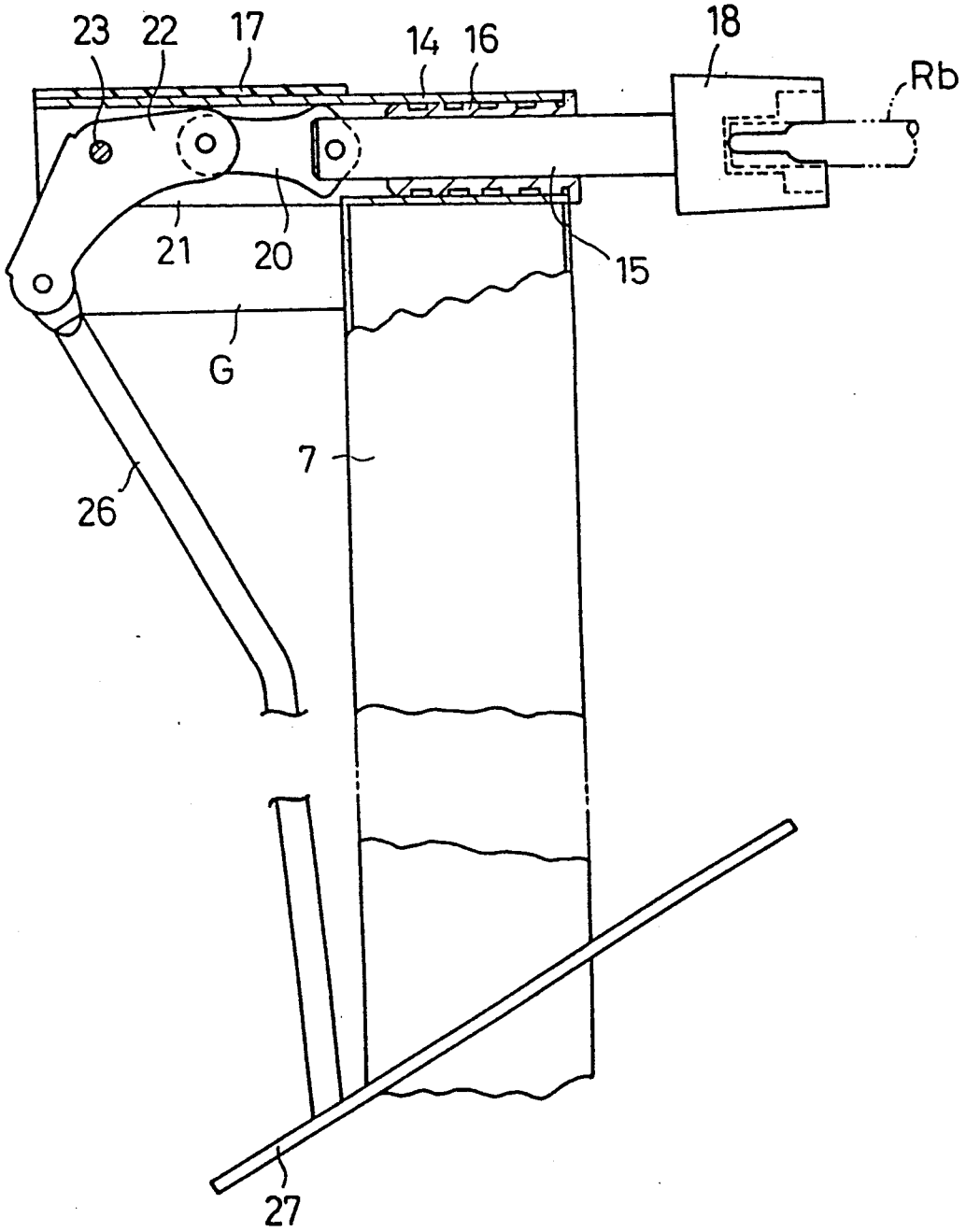
FIG. 3 is a sectional view showing the linkage between the pedal and the piston pin when the piston socket is in the extended position.

As shown in FIGS. 2 and 3, the sleeve 14 is journaled about a slide collar 16; which in turn receives a relatively small diameter piston 15. The slide collar 16 is only shown in FIG. 3. The slide collar 16 frictionally contacts and is slidable within the sleeve 14 to regulate the motion of the piston 15. A socket 18 is carried by the inner end of the piston 15.

The outer end of piston 15 is pivotally coupled to the inner end of a linkage 20 positioned within the sleeve 14. The outer end of the linkage 20 is pivotally coupled to the inner end of a pivot arm 22. The upper end of a connecting rod 26 is pivotally coupled to the outer end of the pivot arm 22. The lower end of the rod 26 is coupled to a foot pedal 27 that is mounted on the lower part of the left leg 7 of the frame 2. The pivoting center 23 of the pivot arm 22 is a pin supported by the sleeve 14, as shown in FIG. 2.

Figure 4:
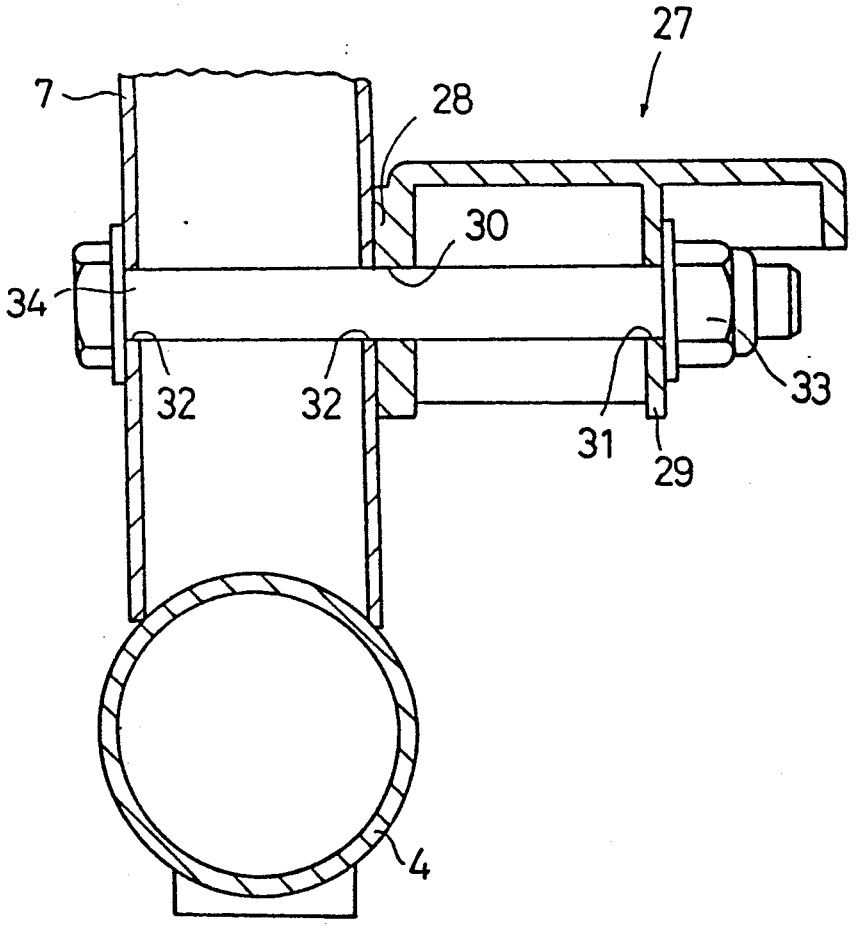
FIG. 4 is a cross-sectional view showing a pedal mounting structure.

The pedal 27 is formed from a hard resin such as polyvinyl chloride or a metallic material. As shown in FIG. 4, the pedal 27 includes a relatively thick plate 28 that extends downwards adjacent the left leg 7. A mounting wall 29 extends downward from a central part of the pedal 27. The petal is secured to the left support leg 7 by a nut and bolt combination 33, 34. Thus, as can be seen in FIG. 4, the bolt extends through a bore 32 formed in the leg 7 into respective bores 30, 31 of the plate 28 and mounting wall 29.

The pedal 27 is pivotally moveable between the non-engaging position shown in FIG. 2 and the engaging position shown in FIG. 3. When the pedal 27 is in the non-engaging position, the connecting rod 26 is in a high position which lifts the outer end of the pivot arm 22 to a raised position. The inner end of pivot arm 22 is thus held at a low position. This in turn draws the linkage 20 towards the pivot arm in a V-like geometry. The motion of linkage 20 pulls the piston 15 back into the sleeve 14, which retracts the socket 18.

On the other hand, when the pedal 27 is moved to the engaging position, the rod 26 is pulled downward. This lowers the outer end of the pivot arm 22 is downward through the slit 21, thereby pivoting the inner end of pivot arm 22 to be pivoted into a raised position. This straightens the connection between linkage 20 and pivot arm 22 which pushes the piston 15 inward from the sleeve 14. Thus, the piston socket 18 is extended toward the positioning socket. Accordingly, the socket 18 engages the second axle hub Rb. This causes the rear wheel B to be rotatably held on the resistance device 2 by the socket 18 and the positioning socket 12.

The side collar 16 within sleeve 14 is in frictional contact with the inner peripheral wall of the sleeve 14. The frictional contact creates a motion suppressing force which tends to hold the piston 15 in place. Thus the pedal 27 is generally held in place unless it is affirmatively moved by the user.

In order to permit changes in the position of the pivoting center 23 of the pivot arm 22, two bores 24 are provided in the sleeve 14 as shown in FIG. 2. Enlarged openings 25 are provided in the sleeve cover 17 to expose the opposing ends of both bores 24. Accordingly, if a bicycle H has a particularly small axle, as for example, a child bicycle or the like, the pivot pin may be inserted into the inner insert bore 24, thereby moving the pivot center 23 inward. This causes the socket 18 to extend further inward, thereby allowing even thin rear wheels B to be held by the exercise stand.

A suitable resistance device 2 is the magnetic resistance device disclosed in commonly assigned U.S. Pat. No. 4,826,150 which is incorporated herein by reference. Accordingly the construction and operation of the resistance device will only be briefly explained herein.

A pair of permanent magnets are arranged on opposite sides of holding a metallic rotating plate fixed to a roller bar. The placement of the magnets is such that eddy currents are generated in the plate when it is rotated. This effectively applied a load to the roller bar. The roller bar in turn frictional engages the rear tire of the bicycle. A control switch that regulates the strength of the magnetic field felt by the rotating plate may be attached to the handle or the like of a bicycle. The control switch allows the user to adjust the resistance generated by the permanent magnets, thereby adjusting the load.

The actions required to mount a bicycle on the described bicycle stand will now be explained. When not in use, the pedal 27 would typically be in the non-engaging position. If desired, the user may first place the tire of the rear wheel B on the roller bar of resistance device 2. One of wheel's hubs Ra, is then set in the positioning socket 12.

Thereafter, the user holds the bicycle such that the other hub is aligned with the piston shaft. Notably, the rear part of the bicycle may be supported with both hands to insure that the first hub Ra is held by the socket 12. In this position, the user may use his or her foot to move the pedal 27 between the non-engaging and engaging positions. This causes the socket 18 to be extended to a holding position which supports the second hub Rb of the axle H. Thus, the rear wheel B is rotatably held on the exercise apparatus by the sockets 12 and 18. This allows the user to use the bicycle as an exercise apparatus.

As described above, the rear wheel may be set on the exercise apparatus by a simple operation. Specifically, the bicycle may be held by the user's hands to properly position the drive wheel. Then the bicycle can be secured to the stand using a simple foot operation by simply depressing the foot pedal 27. Similarly, to release the bicycle, the user needs only to pivot the petal by foot in the opposite direction while again supporting the bicycle with his or her hands.

Although only one embodiment of the present invention has been described in detail herein, it should be apparent to those skilled in the art that the present invention may be embodied in many other specific forms without departing from the spirit or scope of the invention. Particularly, it should be understood that a wide variety of linkages could be provided to transmit motion from the foot pedal to the longitudinally slidable piston.

The resistance device described is a magnetic resistance device. However, it should be understood that wind fans and other resistance devices are contemplated as well. Therefore, the present examples and embodiments are to be considered as illustrative and not restrictive and the invention is not to be limited to the details given herein, but may be modified within the scope of the appended claims.

What is claimed:

1. A bicycle exercise stand for supporting a drive wheel of a bicycle, the drive wheel having a pair of hubs, the bicycle exercise stand comprising:

a frame;

positioning means provided on said frame for engaging and positioning a first one of said drive wheel hubs;

holding means arranged substantially opposite to said positioning means, the holding means being moveable between extended and contracted positions wherein the holding means is arranged to engage a second one of said drive wheel hubs in the extended position to cooperate with the positioning means to rotatably hold the drive wheel; and pedal means mounted to a lower portion of the frame and coupled to holding means for moving the holding means between the extended and contracted positions.

2. A bicycle exercise stand as set forth in claim 1, wherein said positioning means includes:

an internally threaded positioning sleeve;

a threaded shaft which threadably engages the positioning sleeve and extends from the positioning sleeve towards the holding means; and a positioning socket provided at the extended end of said threaded shaft for supporting said first hub to position the rear wheel.

3. A bicycle exercise stand as set forth in claim 2, wherein said postioning means further includes:

an adjust knob provided at a base end of said threaded shaft for facilitating rotation of the threaded shaft; and a lock knob which is threadably fitted onto the threaded shaft between said adjust knob and an end face of the sleeve.

4. A bicycle exercise stand as set forth in claim 1, wherein said holding means includes:

a piston pin slidably arranged in a piston sleeve;

a piston socket carried by a first end of the piston pin for engaging a bicycle hub, wherein the piston pin slides horizontally in the piston sleeve based on the operation of said pedal means, the piston pin being arranged to move the piston pocket between a supporting position that supports that bicycle hub and a free position that is clear of the bicycle hub.

5. A bicycle exercise stand as set forth in claim 4, wherein said pedal means includes a pedal mounted on a lower portion of the frame.

6. A bicycle exercise stand as set forth in claim 5, wherein the pedal means further comprises a linkage means which links said pedal and the piston pin, the linkage means being arranged to convert the operation of said pedal into a horizontal motion of the piston pin.

7. A bicycle exercise stand as set forth in claim 6, wherein said linkage means includes:

a substantially vertically extending connecting rod having a first end coupled to said pedal, said connecting rod being moved substantially vertically according to the operation of the pedal; and a pivot arrangement coupled between a second end of said connecting rod and a second end of the piston pin, said pivot arrangement converting the substantially vertical movement of the connecting rod into a substantially horizontal motion in the piston pin.

8. A bicycle exercise stand as set forth in claim 7, further comprising:

a plurality of parallel bores provided in the peripheral walls of said piston sleeve;

a pivot pin that passes through the pivot arm and one of said bores for pivotally supporting the pivot arm.

9. A bicycle exercise stand as set forth in claim 1, further comprising in resistance means for applying a resistance to the rotation of said drive wheel.

10. A bicycle exercise stand for supporting a drive wheel of a bicycle, the drive wheel having a pair of hubs, the bicycle exercise stand comprising:

a frame;

a first sleeve provided on said frame, the first sleeve being internally threaded;

a threaded shaft which is threadably inserted into said first sleeve, the threaded shaft having a knob means on a first end thereof for permitting rotation of the threaded shaft and carrying a positioning socket on a second end for engaging a first hub of the drive wheel, the threaded shaft being axially moveable to position the drive wheel relative to the frame;

a second sleeve provided on said frame substantially opposite the first sleeve;

a piston pin slidably arranged in the second sleeve;

a piston socket for engaging a second hub of the drive wheel, the piston socket being carried by a first end of the piston pin such that it faces the postioning socket;

a pedal mounted to a lower part of said frame; and linkage means which links said pedal and the piston pin, and converts the operation of the pedal into a horizontal motion of the piston pin.

11. A bicycle exercise stand as set forth in claim 10, further comprising:

an adjust knob provided at a base end of said threaded shaft for facilitating rotation of the threaded shaft; and a lock knob which is threadably fitted onto the threaded shaft between said adjust knob and an end face of the sleeve.

12. A bicycle exercise stand as set forth in claim 10, wherein said linkage means includes:

a substantially vertically extending connecting rod having a first end coupled to said pedal, said connecting rod being moved substantially vertically according to the operation of the pedal; and a pivot arm coupled to a second end of said linkage rod said pivot arm being pivotally coupled to said second sleeve; and a linkage coupled between a second end of the pivot arm and a second end of said piston pin, the linkage and the pivot arm cooperating to transfer the substantially vertical motion of the connecting rod into substantially horizontal motion of the piston pin.

13. A bicycle exercise stand as set forth in claim 10, further comprising:

a cover for covering said second sleeve;

a plurality of parallel bores provided in the peripheral wall of said second sleeve;

a pivot pin positioned in one of said bores, for supporting said pivot arm, said pivot pin being the pivot center of the pivot arm; and a slot formed in the cover for exposing said bores.

14. A bicycle exercise stand as set forth in claim 10, further comprising resistance means for applying resistance to the rotation of said drive wheel.

15. A bicycle exercise stand comprising:

a frame;

an internally threaded first sleeve that is carried by the frame;

a threaded shaft which is threadably inserted into said first sleeve and extends from the first sleeve to a piston socket;

a positioning socket which is provided at first end of said threaded shaft and supports a rotating shaft of a hub of a bicycle;

an adjust knob which is provided at a second end of said threaded shaft and operated to adjust the threadably inserted amount of the threaded shaft into the sleeve;

a lock knob which is threadably fitted onto the threaded shaft between said adjust knob and the end face of the sleeve, and after the threadably inserted amount of the threaded shaft into the sleeve is adjusted by the adjust knob, threadably advanced on said threaded shaft to said end face, and locks the threaded shaft to fix the position of the sleeve;

a piston pin slidably arranged in a second sleeve;

a piston socket provided at the end of the positioning socket extending from the second sleeve of said piston pin;

said piston pin sliding horizontally in the second sleeve, and at this point, moving the piston socket to a position close to the positioning socket to apply the socket to slide over the rotating shaft of said hub;

a pedal arranged on the lower part of said piston pin;

a linkage rod whose first end is linked to said pedal to extend upward, said linkage rod being moved substantially vertically according to the pedal operation of the pedal; and a pivot arm which links a second end of said linkage rod and the end in the sleeve of the piston pin, said pivot arm converting the substantially vertical movement of the linkage rod into a horizontal motion.

16. A bicycle exercise stand as set forth in claim 15, further comprising:

a cover for covering said second sleeve;

a plurality of parallel bores provided in the peripheral wall of said second sleeve;

a pivot pin positioned in one of said bores, for supporting said pivot arm, said pivot pin being the pivot center of the pivot arm; and a slot formed in the cover for exposing said bores.

17. A bicycle exercise stand as set forth in claim 16, further comprising resistance means for applying a resistance to the rotation of said drive wheel.

* * * * *